United States Patent [19]

Bergman

[11] Patent Number: 4,829,928

[45] Date of Patent: May 16, 1989

[54] OCEAN PLATFORM

[75] Inventor: Gunnar Bergman, Santa Barbara, Calif.

[73] Assignee: Seatek Limited, Goleta, Calif.

[21] Appl. No.: 110,930

[22] Filed: Oct. 20, 1987

[51] Int. Cl.[4] ..... B63B 35/44

[52] U.S. Cl. ..... 114/125; 114/264; 114/265

[58] Field of Search ..... 114/264, 265, 121, 125

[56] References Cited

U.S. PATENT DOCUMENTS

| | | | |
|---|---|---|---|
| 138,293 | 4/1873 | Stoner . | |
| 708,287 | 9/1902 | Williams . | |
| 3,221,506 | 12/1965 | Stratton et al. . | |
| 3,407,766 | 10/1968 | Bergman et al. . | |
| 3,407,767 | 10/1986 | McClintock et al. . | |
| 3,442,239 | 5/1969 | Wilson . | |
| 3,460,501 | 8/1969 | Silverman . | |
| 3,515,084 | 6/1970 | Holmes | 114/264 |
| 3,626,701 | 12/1971 | Laffont . | |
| 3,986,471 | 10/1976 | Haselton | 114/265 |
| 4,108,102 | 8/1978 | Lindstrom | 114/264 |
| 4,112,864 | 9/1978 | Bergman | 114/265 |
| 4,221,504 | 9/1980 | Person et al. | 114/264 |
| 4,627,767 | 12/1986 | Field et al. | 405/196 |

FOREIGN PATENT DOCUMENTS

| | | | |
|---|---|---|---|
| 2448551 | 5/1976 | Fed. Rep. of Germany | 114/265 |
| 990582 | 1/1983 | U.S.S.R. | 114/264 |
| 2147549 | 5/1985 | United Kingdom | 114/264 |

*Primary Examiner*—Sherman D. Basinger
*Assistant Examiner*—Thomas J. Brahan
*Attorney, Agent, or Firm*—Christie, Parker & Hale

[57] ABSTRACT

An ocean platform has a negatively buoyant pontoon suspended from the balance of the platform to increase the heave resonant period to at least 25 seconds. Tendons suspend the pontoon to a depth where dynamic wave forces do not materially act directly on it in seas of normally occurring periods of up to about 15 seconds but do in seas of periods above about 15 seconds. Columns and an upper pontoon provide buoyancy for the platform.

27 Claims, 2 Drawing Sheets

OCEAN PLATFORM

BACKGROUND OF THE INVENTION

In general the present invention relates to exploration or production platforms for petroleum or mining.

One type of exploration or production platform is the semi-submersible. A semi-submersible has a deck supported by a plurality of columns that in turn attach to pontoons. The pontoons are totally submerged in the sea and the columns extend upwardly from the pontoons through the water surface and above it to the deck; the deck being spaced above the sea surface. The pontoons and columns below the water surface provide buoyancy. The deck provides the work area. Semi-submersibles are large structures. A typical deck may bee on the order of 90 meters across.

Swell or wave induced motion on a semi-submersible can be serious. (In general, swell is a wave having a narrow period spectrum. A storm sea, in contrast, is the resultant of individual waves of different periods and has a broad spectrum. In this specification, wave will be used to embrace both unless the content requires delineation.)

Heave is vertical motion and is one of the motions induced by waves.

Dynamic wave forces that produce a heave decrease with depth. Surfaces of constant pressure, isobars, in waves are farther apart under wave crests and closer together under wave troughs. The effect of waves on isobars is greatest close to the wave surface. At greater and greater depths, the isobars flatten out until wave influence disappears entirely, and the isobars become equally spaced horizontal surfaces.

Heave occurs because of changes in the vertical forces acting on a platform; a change in the shape of the isobars. In quiet water without waves, a platform experiences only its gravity force acting downward and an equal and opposite buoyant force acting upward. Accordingly, the platform experiences no vertical motion. When waves disturb the water, additional, dynamic forces act on the platform. In the case of a column that passes through the water surface, the wave force acting on it in heave is in phase with wave motion: the wave force is a positive maximum at a wave crest and a negative minimum at a wave trough, with positive and negative being with respect to buoyant forces acting in a quiet sea. In the case of each element of a pontoon, heave forces are out of phase with wave motion: the wave force is a positive maximum at a wave trough and a negative minimum at a wave crest. In a platform integrated from a plurality of pontoons and columns, the resultant direction of the heave force on the platform varies as a function of wave period and platform geometry, including horizontal dimension. For example, a pontoon aligned in the direction of travel of a wave and with the crest of the wave over the middle of the pontoon will experience a negative force under the crest and progressively more and more positive forces towards the troughs. Depending on the length of the pontoon and the wave period, the net force on the pontoon can either be up or down. In the case of a plurality of columns of a structure, if the columns at a given time are in troughs, the wave force on them is negative, and, conversely, if the columns are in a crest, the wave force on them is positive.

The magnitude of wave heave forces increases with wave amplitude. The longer the wave period, the deeper the wave heave forces will be felt. Large amplitude waves generally have long periods, that is not to say that large amplitude waves do not exist with shorter periods and vice versa.

What has just been described is the magnitude and direction of the dynamic forces that produce heave. These forces act on the mass of a platform and a mass of water moved by the platform in heave. This mass of water is called added mass, and its magnitude is a function only of configuration of the object that moves the water. In a right cylinder moving transverse to its generating axis, the added mass is equal to the mass of the volume of water displaced by the cylinder. Displaced mass is simply the volume of the object multiplied by the density of water: the mass of water that would occupy the space occupied by the object if the object were not there. The effective mass of an entire platform is its actual mass plus the added water mass. The actual mass includes the liks of any ballast and things carried by the platform. In a sea without waves, the actual mass of the platform is equal to its displaced mass because the platform is in equilibrium. Knowing the mass of the platform and the added mass of water is not enough to determine the platform's motion response because the third variable, force, in Newton's Second Law equation is not known. The force acting on a completely submerged object, such as a pontoon, comes out to be the sum of the mass of the water displaced by the object and the added mass of water produced by the object multiplied by the acceleration of the water without the object. The force acting on the columns can be determined by knowledge of the columns' horizontal cross-sectional area and pressure on the area as a function of time. Knowledge, then, of the displaced mass of the pontoons, the added mass of the pontoons, the cross-sectional area of the columns, the mass of the platform, the draft of the pontoons and columns, and the sea period can be used to determine the platform's motion response.

My U.S. Pat. No. 4,112,864 describes wave induced heave of a semi-submersible and a means for reducing heave by taking advantage of different phases of the dynamic forces of the waves acting on different parts of the pontoons. The patent describes a characteristic heave response of semi-submersibles. At a period of, say, 20 seconds the semi-submersible becomes resonant. Below this period there is a secondary maximum at, say, about 13 seconds at which heave response can be serious.

A tension leg platform is another type of exploration or production platform. A tension leg platform has columns extending from a deck through the water surface and below to pontoons. As before, the columns below the water surface and pontoons provide positive buoyancy. Tension legs, however, tie the platform to the ocean bottom. This restraint, obviously, can reduce heave motion by preventing the platform from moving very much in response to wave forces.

In most hostile open ocean areas the semi-submersible platform is very satisfactory for exploration and production of petroleum. However, in areas where very long waves occasionally occur, with periods as long as 24–25 seconds, the semi-submersible platform can experience serious problems because of its resonant period. In principle, it is possible to modify the design of the semi-submersible so that the natural period of heave becomes longer than 24–25 seconds to at least ameliorate the heave motion problem occurring in long wave periods. This can be done by increasing the size of the submerged pontoons, for example. If this is done, heave motion becomes worse at the shorter wave periods that are more frequently experienced. Changing the natural period can also be done by increasing the height of the columns to increase draft of the platform. But the required increase is considerable if the natural period is to be sufficiently increased to avoid the problem; the draft of the columns could be in excess of 100 meters, and the design would be expensive. In addition, with such a large draft, the semi-submersible would not be stable in the early part of its submersion with the pontoons just a short distance below the water line unless the columns canted outward, and that can lead to structural design problems.

The tension legs of tension leg platforms must be kept in tension at all times to avoid shock loads. Consequently, the legs are pre-stressed in tension a sufficient amount to accommodate expected changes in vertical forces of the platform and still be under tension. Because of considerable variations in stress, the legs are large in cross section and expensive. These variations are to a large extent due to wave forces, but there are other causes. One example is the variation in stress that occurs with wind movement of the platform. A platform moves with the wind until the horizontal component of tension balances the wind force. The horizontal movement is a component of movement in a circular arc and is therefore accompanied by an increase in draft, thus increasing the tension on the legs because of an increase in buoyant force on the platform. In deep water, this tension increase is considerable. The legs must also have enough reserve tension for variations in deck load, from drill pipe, for example, and the amount of oil and drilling fluids stored anywhere on the platform. The legs must also be strong enough to accommodate expected tides, which can be on the order of one to two meters. Aside from the requirement of variations in load that force strong legs, in very deep water, in excess of 1,000 meters, it is difficult to avoid resonant motions in heave, roll and pitch excited by normally occurring waves because of the inevitably greater elasticity of the legs. In addition, legs anchored to the sea floor may require inspection, and in deep water that can be difficult or impossible. Also, the attachment of the legs to the platform and the sea floor must accommodate fairly large angular deflections; this presents design problems.

SUMMARY OF THE INVENTION

The present invention provides an exploration or production platform for use, for example, in petroleum and mining activities that can be used in deep water without the disadvantages of tension leg platforms and in seas with very long wave periods without the disadvantages of semi-submersibles. It has a negatively buoyant pontoon that permits the platform to have a resonant period in heave of 25 seconds or longer without producing an unacceptable secondary maximum at shorter wave periods.

In general, the present invention contemplates a platform that has a deck mounted on a plurality of buoyant columns so that the deck is above the sea surface. Flexible tendons suspend a negatively buoyant pontoon from the rest of the vessel. The negative buoyancy is sufficient to avoid tendon slack from platform response to wave forces. The negative buoyancy should be no greater than necessary to keep tension so that the load on the tendons is low and their thickness small. The suspended pontoon has a fairly deep draft, arount 100 meters, so that dynamic wave forces do not act appreciably on it in commonly occurring waves. For the uncommon long waves, of say 20 seconds or more, the d raft of the suspended pontoon is shallow enough that significant dynamic wave forces act on it in opposition to the heave force on the balance of the platform. This reduces the heave that the platform would otherwise experience. The platform has a natural period of heave of at least about 25 seconds so that it will not be excited in resonance by waves of shorter periods, waves of, for example, 22–23 seconds. It may be necessary to increase the natural period to above 25 seconds to as much as 30 seconds because some seas have 25 second periods. The displaced mass of the pontoon, the negative buoyancy mass, and the added mass of sea water in heave is at least about 50% of the total effective mass of the platform, constituted of its mass and the added mass of sea water in heave, of this about 5% of the total effective mass is in the negative buoyancy. Since the mass of the platform is its diplaced mass in a waveless sea, the effective mass of the platform is equal to this displaced mass plus the added mass of water in heave.

To lower the amplitude of tension fluctuation in the tendons, I prefer to use a second, smaller pontoon attached to the columns at their lower ends in the manner of a standard semi-submersible. The tendons that suspend the negatively buoyant pontoon attach to the bottoms of the columns. The upper pontoon attenuates heave force on the structure above the lower pontoon in accordance with known principles. The teachings of my U.S. Pat. No. 4,112,864 can well be employed in the design of the upper pontoon.

Preferably, the sum of the displaced mass, added mass, and negative buoyancy mass of the negatively buoyant pontoon is at least about 65% of the effective mass of the entire platform. For the upper pontoon, the displaced plus added mass is preferably about 20% of the effective mass of the entire platform. When no upper pontoon is used, the displaced mass, added mass, and negative buoyancy mass of the negatively buoyant pontoon is about 85% of the effective mass of the entire platform, of which about 5% is the negative buoyancy mass. Preferably, the draft of the columns is from about 25 to about 55 meters and the draft of the negatively buoyant pontoon is from about 80 to about 150 meters.

In a specific form, the present invention contemplates a platform that has a deck with four columns in a square pattern supporting the deck above the surface of the water and extending below the water surface to provide buoyancy. The negatively buoyant pontoon in plan is generally square shaped with an open center, like a picture frame. It has a displaced mass, added mass, and negative buoyancy mass of at least about 65% of the total effective mass of the platform. The flexible tendons suspend this negatively buoyant pontoon at a depth where dynamic wave forces are not significant during commonly occurring seas, seas below 15 seconds, but shallow enough that seas of higher period act significantly on it. The natural period of heave of the platform is at least about 25 seconds. I prefer an upper pontoon attached to the columns in the manner of a semi-submersible to attenuate tendon tension changes. Again, for the case where no upper pontoon is used, the displaced mass, added mass, and ballast mass of the negatively buoyant pontoon is about 85% of the effective mass of the entire platform.

The displacement of the platform can vary without changing its motion characteristics by maintaining certain dimensional relationships. For a platform with circular pontoons and columns and an upper pontoon, the diameter of the upper pontoon should be about 60% of the diameter of each of the columns and the diameter of the suspended pontoon should be about 95% of the diameter of each of the columns. For a platform without an upper pontoon and with a circular lower pontoon and columns, the diameter of the suspended pontoon should be about 110% of the diameter of each of the columns.

The present invention also contemplates a method of assembling the platform. In general, this method contemplates assembling the upper portion of the platform, consisting of the deck, upper pontoon, and columns, on top of the pontoon that will be negatively buoyant. The tendons are attached to the negatively buoyant pontoon. (The tendons may be in guides on the outside of the columns or in tubes either inside or outside of the columns.) The upper ends of at least four of the tendons, one in each corner, are connected to winches installed on the deck of the platform through wire rope. The platform is then towed to a suitable site for lowering of the suspended pontoon. The suspended pontoon is then flooded until it becomes slightly negatively buoyant. The pontoon is then lowered with the winches until at full draft. After it has reached draft, the pontoon is flooded until its proper weight has been reached and the tendons properly preloaded in tension.

These and other features, aspects and advantages of the invention will become more apparent from the following description, appended claims and drawings.

DESCRIPTION OF THE PREFERRED EMBODIMENT

Figure 2:
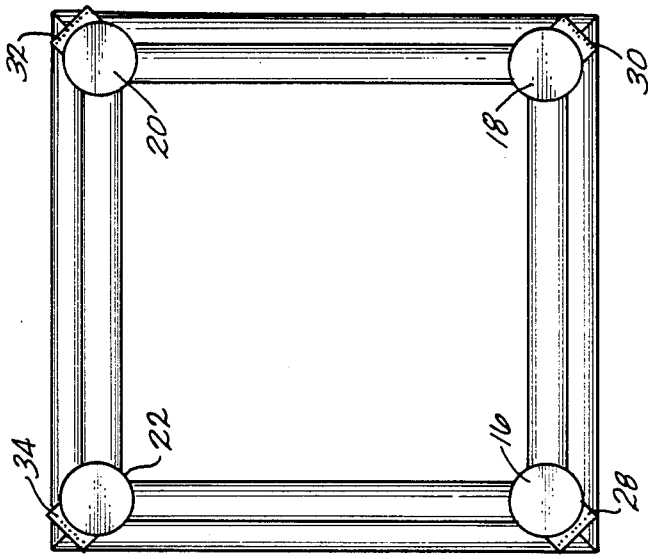
FIG. 2 is a view taken in the plane of 2—2 in FIG. 1, showing the upper buoyant pontoon and associated columns and the lower pontoon partially obscured.

With reference to the first three figures, a platform 10 has a deck 12 maintained above sea level, indicated at 14, by four buoyant columns 16, 18, 20 and 22 and an upper pontoon 24. A suspended pontoon 26 is slightly negatively buoyant because it includes ballast water. A plurality of tension legs or tendons at the basis of the columns adjacent to the upper pontoon suspend the lower pontoon. These tendons are shown at 28, 30, 32 and 34.

The deck is square. The columns are in a square array. Upper pontoon 24 is square in plan with an open center like a picture frame. Suspended pontoon 26 is also square in plan with an open center.

Typical dimensions and displacements are indicated in the table below:

| | |
|---|---|
| Diameter of each column | 12 meters |
| Centerline distance between columns | 76 meters |
| Deck length | 90 meters |
| Column height | 62.5 meters |
| Column draft | 40 meters |
| Upper pontoon diameter | 7.2 meters |
| Length of each leg of upper pontoon about | 65 meters |
| Suspended pontoon diameter | 11.4 meters |
| Centerline-to-centerline length of each leg of suspended pontoon | 80 meters |
| Centerline suspended pontoon draft | 100 meters |
| Approximate effective mass of platform | 102,000 metric tons |
| Approximate displaced mass and added mass of suspended pontoon | 62,000 metric tons |
| Approximate suspended pontoon negative buoyancy | 4,000 metric tons |
| Approximate displaced mass and added mass of upper pontoon | 22,000 metric tons |
| Natural period of heave | 30 seconds |
| Air gap of mean water line to deck | 23 meters |

Typically, the draft of the upper portion of the platform will be between 40 and 45 meters and the draft of the suspended pontoon will be between about 100 and 110 meters. Typically, the natural period of heave of the platform is between 27 and 30 seconds.

As stated earlier, heave forces tend to produce vertical motion of the platform. That motion, in accordance with Newton Second Law, is resisted by the mass of the platform and the added mass of the water for the platform. The mass of the platform is its diplaced mass in a waveless sea. The added mass of water measures the water mass that moves with the platform. It turns out for a cylindrical pontoon moving transverse to its generating axis that the added mass is equal to the mass of water displaced by the cylinder. For the negatively buoyant pontoon in the embodiment illustrated, the mass of the pontoon is 31,000 metric tons and the added mass is 31,000 metric tons and the negative buoyancy mass is 4,000 metric tons. The displaced mass of the negatively buoyant pontoon is also 31,000 metric tons. The displaced mass for the upper pontoon is 11,000 tons and the added mass is 11,000 tons.

The illustrated embodiment has a total effective mass of 102,000 metric tons. The added mass of the entire platform is 42,000 metric tons. The mass of the platform, of course, equals the mass of water displaced by the platform in equilibrium, and that is 60,000 metric tons.

It is possible to have a platform without the upper pontoon. Such a platform has some disadvantages relative to the one with an upper pontoon, in particular, the fact that leg tension oscillations are larger and, therefore, the tendons must be made stronger. In addition, the suspended pontoon must be quite a bit larger. For such a structure with a total effective mass of 102,000 metric tons, the upper structure of the deck and columns constitutes 14,000 metric tons, the lower pontoon has a mass of 46,000 tons, including ballast of 4,000 metric tons, and an added mass of 42,000 tons.

The mass plus added mass of the suspended pontoon should be at least 50% of the effective mass of the entire platform. If the mass plus added mass of the suspended pontoon gets much lower than this, the pontoon at wave periods below 15 seconds will not have enough inertia (its mass plus added mass) to reduce heave motion on the upper part of the platform produced by wave forces acting on the upper part of the platform (while the suspended pontoon is not directly affected much by heave forces acting on it and only affected by heave forces acting through the tendons, it becomes too small to provide enough inertia to be effective). The mass plus added mass of this pontoon should be 10 to 15 times larger than the mass corresponding to the negative buoyancy. In addition, the suspended pontoon has to have enough added mass and a shallow enough draft so that in seas above 20 seconds the suspended pontoon produces forces in opposition to the heave forces on the structure above it sufficient to effectively attenuate heave. A draft of about 100 meters for the suspended pontoon in such long periods seas will effectively attenuate heave.

The negative buoyancy should be just enough to keep tension in the tendons at all times. All times means at all wave periods to 25 seconds or wave heights up to 30 meters. Any more increases the cost of the tendons because theyhave to be made stronger. A negative buoyancy of about 5% of the effective mass of the entire platform is satisfactory.

The displacement of the platform can be changed while keeping the heave response the same by keeping a ratio of a characteristic dimension of the pontoons and columns the same. For this purpose, when the columns and pontoons are circularly cylindrical, the diameter of the upper pontoon is about 60% of the diameter of each of the columns and the diameter of the suspended pontoon is about 95% of the diameter of each column. For a platform without an upper pontoon, the diameter of the suspended pontoon should be about 110% of the diameter of each of the columns.

Figure 1:
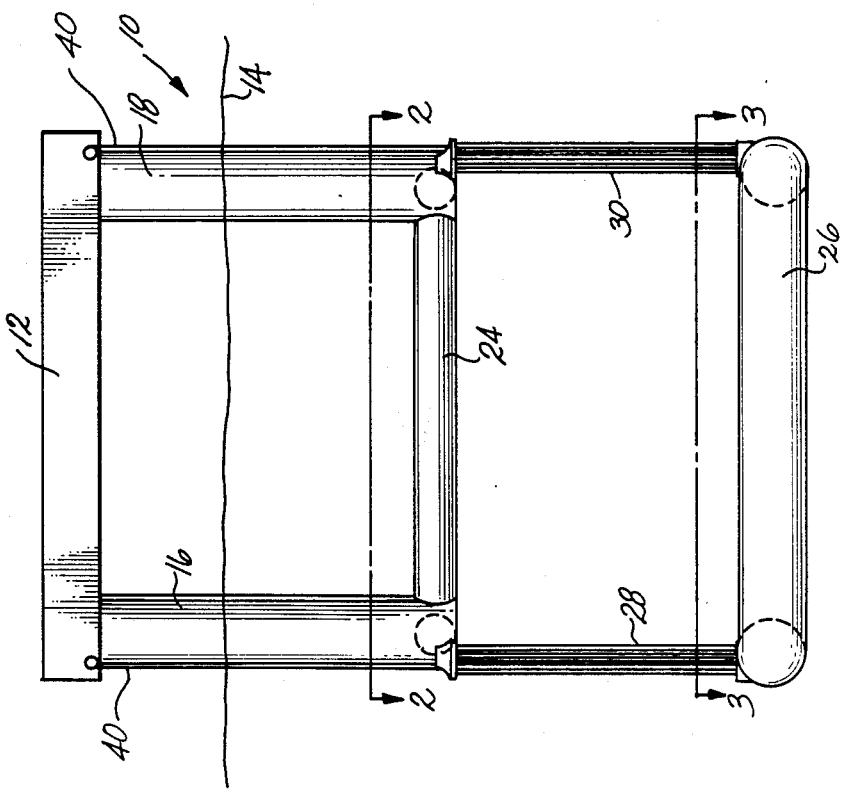
FIG. 1 is an elevational view of the preferred embodiment of the platform of the present invention.

The assembly of the platform follows a unique sequence. The suspended pontoon is first constructed. After this construction, the upper portion of the platform is begun. First, the smaller upper pontoon is fabricated on top of the suspended pontoon, but not attached to it. Then, the columns and platform deck are constructed on the upper pontoon. The dimension of the deck is on the order of 90 meters. Thereafter, the tendons are attached to the outside of the columns or within the columns. The tendons are on the order of 50 meters long, e.g., the 55 meters of the described embodiment. At least four of the upper ends of the tendons, one for each corner, are then connected to winches through standard wire rope. The standard wire rope is tensioned by the winches shown in FIG. 1 by reference numeral 40. At this point, the entire assembly can be towed to water of a depth deeper than the draft of the lower pontoon when deployed, say a depth of 130 meters. Then the suspended pontoon is flooded until it is slightly negatively buoyant. The suspended pontoon is then lowered by the winches, the tendons lowering with it until seated in their seats. The wire ropes are then removed from the tendons. At this point, the flooding of the pontoon can continue to get the correct negative buoyancy. Then, the platform can be towed to location and anchored by standard mooring techniques. These steps can be reversed to demobilize the platform.

Figure 4:
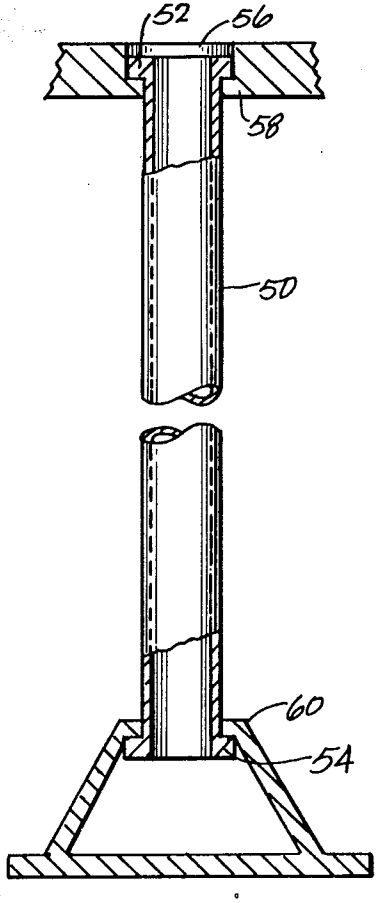
FIG. 4 shows in side elevation the preferred form of tendons and their mounting.
Figure 3:
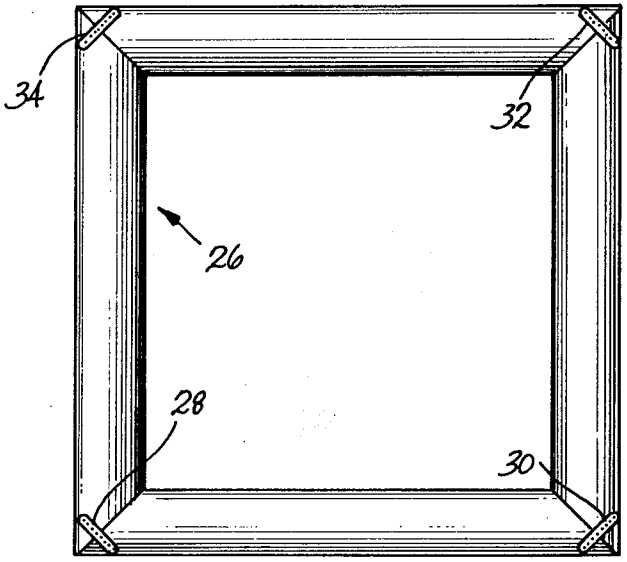
FIG. 3 is a view taken in the plane of 3—3 in FIG. 1, showing the plan configuration of the suspended pontoon of the present invention.

FIG. 4 shows a preferred form of the tendons of the present invention. Each tendon consists of a tube of steel assembled from several sections. One of these tendons is shown by reference numeral 50. The top section has an upper external flange 52 and the lower section, a lower external flange 54. A seat 56 formed at the corner of one of the columns has a flange 58 that flange 52 can abut against. When fabricated but before deployment, the upper pontoon rests on the suspended pontoon and the tendons extend upward the 60 meters or so of their length from the bottom of the upper pontoon. As previously indicated, these tendons can pass through the columns or be guided on guides on the outside of the columns. Lower flange 54 of each tendon seats in a lower seat 60 of the suspended pontoon. Some angular displacement of the tendons on their seats is possible.

The present invention provides a platform that is particularly useful when seas of wave components of 20 to 25 seconds can be expected. Such seas can be of the major storm type and have a maximum wave height of 30 meters. They can also take the form of very long swells with a wave height of, say, five meters. Both types may be experienced in the North Sea. The conventional semi-submersible will not perform satisfactorily in such seas because the resonant period of these vessels is in the 20 to 23 second range. If the resonant period is increased, the secondary maximum also increases and heave response at this maximum becomes unsatisfactory.

The platform of the invention in such environments has many advantages over a tension leg platform. When the platform is displaced by wind current and wave draft forces, its draft is not increased. Accordingly, there is no tension increase in the tendons. Second, there is no tension change when the platform load is changed. Third, there is no tension change with tides. Fourth, the suspended pontoon platform works just as well in deep waters as in shallow waters. Fifth, inspection is much easier at 100 meters than at great depths. Sixth, the tendons do not have to be designed for as large bending angles at their ends. Finally, there is no need for anchoring systems in the sea flow.

The present invention has been described with reference to a preferred embodiment. The spirit and scope of the appended claims should not, however, necessarily be limited to this description. Platforms with more columns and different pontoon configurations can use the principles of this invention, for example, platforms of pentagonal or hexagonal symmetry.

I claim:

1. An exploration or production platform comprising;

(a) deck;

(b) buoyancy means including a plurality of buoyant columns attached to the deck for keeping the platform afloat at sea with the upper portion of the columns being above the sea surface and the deck spaced from the sea surface;

(c) negatively buoyant pontoon means for providing negative buoyancy and having a displaced mass and an added mass of sea water of at least about 45% of the total effective mass of the platform, the added mass being substantially the same for both directions of vertical motion of the negatively buoyant pontoon;

(d) flexible tendon means for suspending the negatively buoyant pontoon means from below the balance of the platform to a depth above the sea bottom and where wave induced dynamic forces on the pontoon are small and do not materially contribute to the heave response of the platform at commonly experienced wave periods but where wave induced dynamic forces do act on the pontoon at higher wave periods below resonance of the platform, the negatively buoyant pontoon means being capable of having a negative buoyancy sufficient to keep tension in the tendon means during all sea conditions; and (e) the platform having natural period in heave of at least about 25 seconds.

2. The platform claimed in claim 1 including:

upper pontoon means attached to the columns at their lower ends, the tendon means supporting the negatively buoyant pontoon means below the upper pontoon means.

3. The platform claimed in claim 2 wherein:

the displaced mass and added mass of the negatively buoyant pontoon means is at least about 60% of the effective mass of the entire platform.

4. The platform claimed in claim 2 wherein:

the draft of the columns is from about 25 to about 55 meters and the draft of the negatively buoyant pontoon means is from about 80 to about 150 meters.

5. The platform claimed in claim 4 wherein:

the upper pontoon means has a displaced mass and an added mass of about 20% of the effective mass of the entire platform; and the displaced mass and added mass of the negatively buoyant pontoon means is about 60% of the effective mass of the entire platform.

6. The platform claimed in claim 2 wherein:

the draft of the negatively buoyant pontoon means and the configuration of such pontoon means are such that with wave periods of from about 20 to 25 seconds such pontoon means experience heave forces that materially oppose heave forces on the balance of the platform.

7. The platform claimed in claim 6 wherein:

the draft of the negatively buoyant pontoon means is from about 80 to about 150 meters.

8. The platform claimed in claim 7 wherein:

the upper pontoon means has a displaced mass and added mass of about 20% of the effective mass of the entire platform; and the displaced mass and added mass of the negative buoyant pontoon means is about 60% of the effective mass of the entire platform.

9. The platform claimed in claim 8 wherein:

the negatively buoyant pontoon means is capable of a negative buoyancy of about 5% of the effective mass of the entire platform.

10. The platform claimed in claim 6 wherein:

the upper pontoon means has a displaced mass and an added mass of about 20% of the effective mass of the entire platform.

11. An exploration or production platform comprising:

(a) a deck;

(b) buoyancy means including at least four columns in a square pattern attached to the deck for keeping the platform afloat at sea with the upper portion of the columns above the sea surface and the deck spaced from the sea surface;

(c) a negatively buoyant pontoon for providing negative buoyancy and a large displaced and added mass, the negatively buoyant pontoon in plan view being generally square shaped with an open center and having a displaced mass and added mass of sea water at least about 60% of the total effective mass of the platform, the added mass being substantially the same for both directions of vertical motion of the negatively buoyant pontoon;

(d) flexible tendon means for suspending the negative buoyant pontoon from below the balance of the platform to a depth above the sea bottom and where wave induced dynamic forces on the pontoon are small and do not materially contribute to the heave response of the platform in waves of normally occurring periods, but where wave induced dynamic forces do act on the negatively buoyant pontoon at higher wave periods below resonance of the platform the negative buoyancy of the negatively buoyant pontoon means maintaining the tendons in tension during all sea periods up to about 25 seconds or wave heights of 30 meters; and (e) the platform having a natural period of heave of at least about 25 seconds.

12. The platform claimed in claim 11 including;

an upper pontoon that in plan view is generally square shaped with an open center; the columns attaching to the upper pontoon at its corners, the tendon means supporting the negatively buoyant pontoon below the upper pontoon.

13. The platform claimed in claim 12 wherein:

the upper pontoon, the buoyant pontoon, and each of the columns has a cylindrical cross section and a characteristic diameter, the diameter of the upper pontoon being about 60% of the diameter of each of the columns and the diameter of the negatively buoyant pontoon being about 95% of the diameter of each of the columns.

14. The platform claimed in claim 12 wherein:

the upper pontoon has a displaced mass and an added mass of about 20% of the effective mass of the entire platform.

15. The platform claimed in claim 14 wherein:

the negatively buoyant pontoon is capable of a negative buoyancy of about 5% of the effective mass of the entire platform.

16. The platform claimed in claim 15 wherein:

the draft of the columns is from about 25 to about 55 meters and the draft of the negatively buoyant pontoon is from about 80 to about 150 meters.

17. The platform claimed in claim 14 wherein:

the draft of the columns is from about 25 to about 55 meters and the draft of the negatively buoyant pontoon is from about 80 to about 150 meters.

18. The platform claimed in claim 11 wherein:

the negatively buoyant pontoon and each of the columns has a cylindrical cross section and a characteristic diameter, the diameter of the negatively buoyant pontoon being about 110% of the diameter of each of the columns.

19. The platform claimed in claim 18 wherein:

the displaced mass and added mass of the negatively buoyant pontoon is about 80% of the effective mass of the entire platform.

20. The platform claimed in claim 19 wherein:

the draft of the columns is from about 25 to about 55 meters and the draft of the negatively buoyant pontoon is from about 80 to about 150 meters.

21. A method of fabricating and deploying an ocean platform for exploration or production and having a length dimension on the order of 90 meters comprising the steps of:

(a) fabricating a suspended pontoon;

(b) fabricating an upper pontoon, column and a deck on the suspended pontoon to produce a structure having the deck on top with the columns supporting the deck and extending down from the deck to connect to the upper pontoon;

(c) attaching suspending tendons to the suspended pontoon, each tendon being on the order of 50 meters long;

(d) placing the platform into water having a depth greater than the operational draft of the platform; and then (e) adding ballast water to the suspended pontoon to make it slightly negatively buoyant, and then (f) lowering the suspended pontoon to operational draft and suspending it by the tendons from the balance of the platform; and then (g) adding more ballast water to the suspended pontoon to tension the tendons to a predetermined tension.

22. The method claimed in claim 21 wherein:

the lowering step is done by winches.

23. The method claimed in claim 21 including supporting the tendons on the columns before lowering and guiding them on the columns during lowering.

24. An improvement in an exploration or production platform of the type having a plurality of buoyant columns that support a deck above the water surface and which piece the sea surface and upper pontoons at the base of the columns and below the sea surface, the exploration or production platform having a heave response curve that has a secondary maximum resulting from wave induced forces acting on the pontoons at periods below the platform's resonant period, the improvement comprising:

a negatively buoyant suspended pontoon below the upper pontoons and having an effective mass constituted of its actual mass and its added mass, the added mass being the same in both vertical directions;

flexible tendon means suspending the suspended pontoon below the upper pontoons to a depth where wave forces at the secondary maximum do not materially act on it but where wave forces at higher wave periods below resonance of the platform do materially act on it; and the effective mass of the suspended pontoon being sufficient to increase the natural period of heave.

25. The platform claimed in claim 24 wherein the effective mass of the suspended pontoon is at least about 65% of the effective mass of the entire platform.

26. The platform claimed in claim 25 wherein the displaced mass and added mass of the upper pontoons is about 20% of the effective mass of the entire platform.

27. The platform claimed in claim 26 wherein the suspended pontoon has a negative buoyancy mass of at least 5% of the effective mass of the entire platform.

* * * * *

UNITED STATES PATENT AND TRADEMARK OFFICE

CERTIFICATE OF CORRECTION

PATENT NO. : 4,829,928

DATED : May 16, 1989

INVENTOR(S) : Gunnar Bergman

It is certified that error appears in the above-identified patent and that said Letters Patent is hereby corrected as shown below:

In the Specification:

Column 1, line 17, change "bee" to -- be --.

Column 2, line 19, change "liks" to -- likes --.

Column 4, line 2, change "arount" to -- around --.
Column 4, line 6, change "d raft" to -- draft --.
Column 4, line 22, change "diplaced" to -- displaced --.

Column 6, line 34, change "diplaced" to -- displaced --.

Column 7, line 22, change "theyhave" to -- they have --.

In the Claims:

Column 8, line 47, before "deck" insert -- a --.

Column 10, line 25, before "buoyant" insert -- negatively --.

Column 11, line 26, change "piece" to -- pierce --.

Signed and Sealed this

Third Day of April, 1990

*Attest:*

HARRY F. MANBECK, JR.

*Attesting Officer*

*Commissioner of Patents and Trademarks*